US006112959A

United States Patent [19]

Townsend

[11] Patent Number: 6,112,959

[45] Date of Patent: Sep. 5, 2000

[54] WATERPROOF CARRYING BAG AND BACKPACK

[76] Inventor: Martin Townsend, 9 Baton Close, Watts Wood Purfleet, Essex RM191GW, United Kingdom

[21] Appl. No.: 09/176,842

[22] Filed: Oct. 22, 1998

[51] Int. Cl.[7] ..... A45F 4/02

[52] U.S. Cl. ..... 224/153; 224/579; 224/629; 224/652; 224/640; 224/655; 224/237

[58] Field of Search ..... 224/153, 579, 224/580, 578, 629, 652, 653, 655, 237, 236, 637, 640

[56] References Cited

U.S. PATENT DOCUMENTS 2,764,327 9/1956 Stevenson ..... 224/236
3,938,716 2/1976 Jackson et al. ..... 224/153
4,609,084 9/1986 Thomas ..... 224/153
5,012,964 5/1991 Palletta et al. ..... 224/153

*Primary Examiner*—Linda J. Sholl

[57] ABSTRACT

A waterproof carrying bag and backpack for carrying items therein protected from moisture from the weather and other water sources. The waterproof carrying bag and backpack includes an outer case having top and bottom panels, a pair of side panels, a back panel and an open front. The outer case also has top and bottom flaps substantially covering the open front of the outer case. A handle strap is coupled to the top panel. A harness assembly is detachably attached to the outer case and comprises an elongate flexible top strap and a pair of elongate flexible shoulder straps. A water proof inner pouch is provided in the outer case and is detachably attached to the back panel of the outer case.

9 Claims, 4 Drawing Sheets

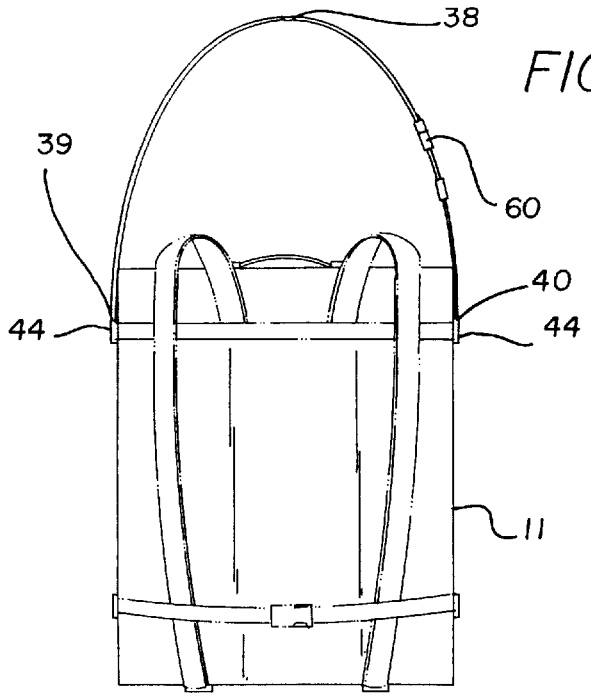
FIG.8
FIG.9
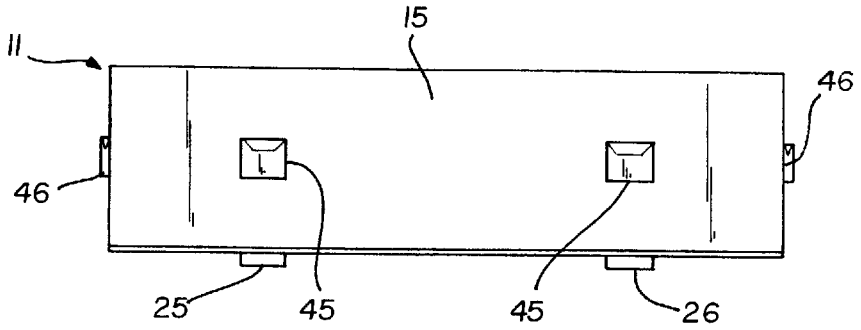
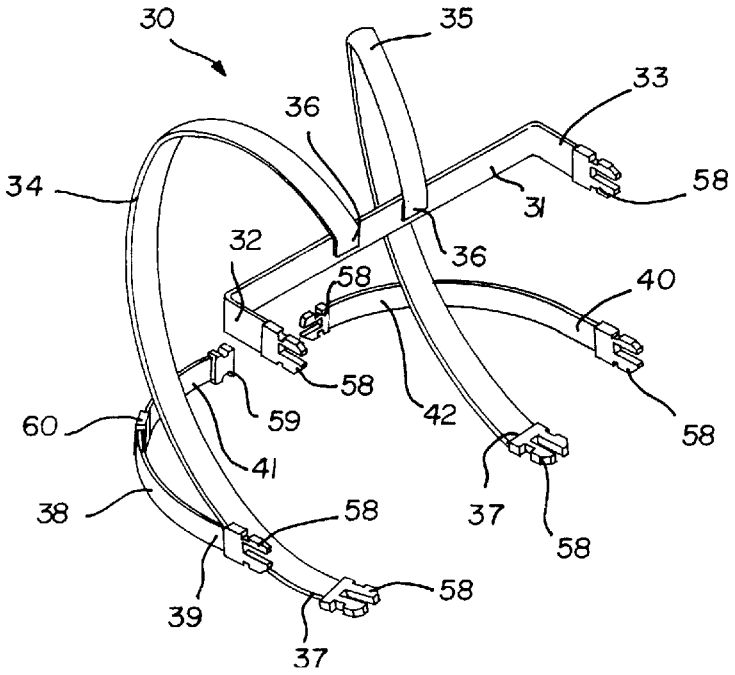
FIG.10

WATERPROOF CARRYING BAG AND BACKPACK

BACKGROUND OF THE INVENTION

1. Field of the Invention

The present invention relates to waterproof carrying bags and backpacks and more particularly pertains to a new waterproof carrying bag and backpack for carrying items therein protected from moisture from the weather and other water sources.

2. Description of the Prior Art

The use of waterproof carrying bags and backpacks is known in the prior art. More specifically, waterproof carrying bags and backpacks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,213,549; U.S. Pat. No. 4,421,150; U.S. Pat. No. 5,201,867; U.S. Pat. No. 1,809,696; U.S. Pat. No. 2,134,441; and U.S. Pat. No. Des. 275,622.

While these devices fulfill their respective, particular objectives and requirements, the aforementioned patents do not disclose a new waterproof carrying bag and backpack. The inventive device includes an outer case having top and bottom panels, a pair of side panels, a back panel and an open front. The outer case also has top and bottom flaps substantially covering the open front of the outer case. A handle strap is coupled to the top panel. A harness assembly is detachably attached to the outer case and comprises an elongate flexible top strap and a pair of elongate flexible shoulder straps. A water proof inner pouch is provided in the outer case and is detachably attached to the back panel of the outer case.

In these respects, the waterproof carrying bag and backpack according to the present invention substantially departs from the conventional concepts and designs of the prior art, and in so doing provides an apparatus primarily developed for the purpose of carrying items therein protected from moisture from the weather and other water sources.

SUMMARY OF THE INVENTION

In view of the foregoing disadvantages inherent in the known types of waterproof carrying bags and backpacks now present in the prior art, the present invention provides a new waterproof carrying bag and backpack construction wherein the same can be utilized for carrying items therein protected from moisture from the weather and other water sources.

The general purpose of the present invention, which will be described subsequently in greater detail, is to provide a new waterproof carrying bag and backpack apparatus and method which has many of the advantages of the waterproof carrying bags and backpacks mentioned heretofore and many novel features that result in a new waterproof carrying bag and backpack which is not anticipated, rendered obvious, suggested, or even implied by any of the prior art waterproof carrying bags and backpacks, either alone or in any combination thereof.

To attain this, the present invention generally comprises an outer case having top and bottom panels, a pair of side panels, a back panel and an open front. The outer case also has top and bottom flaps substantially covering the open front of the outer case. A handle strap is coupled to the top panel. A harness assembly is detachably attached to the outer case and comprises an elongate flexible top strap and a pair of elongate flexible shoulder straps. A water proof inner pouch is provided in the outer case and is detachably attached to the back panel of the outer case.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new waterproof carrying bag and backpack apparatus and method which has many of the advantages of the waterproof carrying bags and backpacks mentioned heretofore and many novel features that result in a new waterproof carrying bag and backpack which is not anticipated, rendered obvious, suggested, or even implied by any of the prior art waterproof carrying bags and backpacks, either alone or in any combination thereof.

It is another object of the present invention to provide a new waterproof carrying bag and backpack which may be easily and efficiently manufactured and marketed.

It is a further object of the present invention to provide a new waterproof carrying bag and backpack which is of a durable and reliable construction.

An even further object of the present invention is to provide a new waterproof carrying bag and backpack which is susceptible of a low cost of manufacture with regard to both materials and labor, and which accordingly is then susceptible of low prices of sale to the consuming public, thereby making such waterproof carrying bag and backpack economically available to the buying public.

Still yet another object of the present invention is to provide a new waterproof carrying bag and backpack which provides in the apparatuses and methods of the prior art some of the advantages thereof, while simultaneously overcoming some of the disadvantages normally associated therewith.

Still another object of the present invention is to provide a new waterproof carrying bag and backpack for carrying items therein protected from moisture from the weather and other water sources.

Yet another object of the present invention is to provide a new waterproof carrying bag and backpack which includes an outer case having top and bottom panels, a pair of side panels, a back panel and an open front. The outer case also has top and bottom flaps substantially covering the open front of the outer case. A handle strap is coupled to the top panel. A harness assembly is detachably attached to the outer case and comprises an elongate flexible top strap and a pair of elongate flexible shoulder straps. A water proof inner pouch is provided in the outer case and is detachably attached to the back panel of the outer case.

Still yet another object of the present invention is to provide a new waterproof carrying bag and backpack that has an inner bag for holding items therein in an organized manner so that the items may be easily located and retrieved by a user.

Even still another object of the present invention is to provide a new waterproof carrying bag and backpack that has a system of interchangeable straps so that the invention may be converted between a carrying bag with a shoulder strap to a backpack with a pair of shoulder straps.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a schematic back side view of the outer case of the present invention with the harness assembly detached and the waist strap attached to the top receiver portions to serve as a single shoulder strap.

FIG. 9 is a schematic bottom side view of the outer case of the present invention.

FIG. 10 is a schematic perspective view of the harness assembly and waist strap of the present invention.

DESCRIPTION OF THE PREFERRED EMBODIMENT

Figure 1:
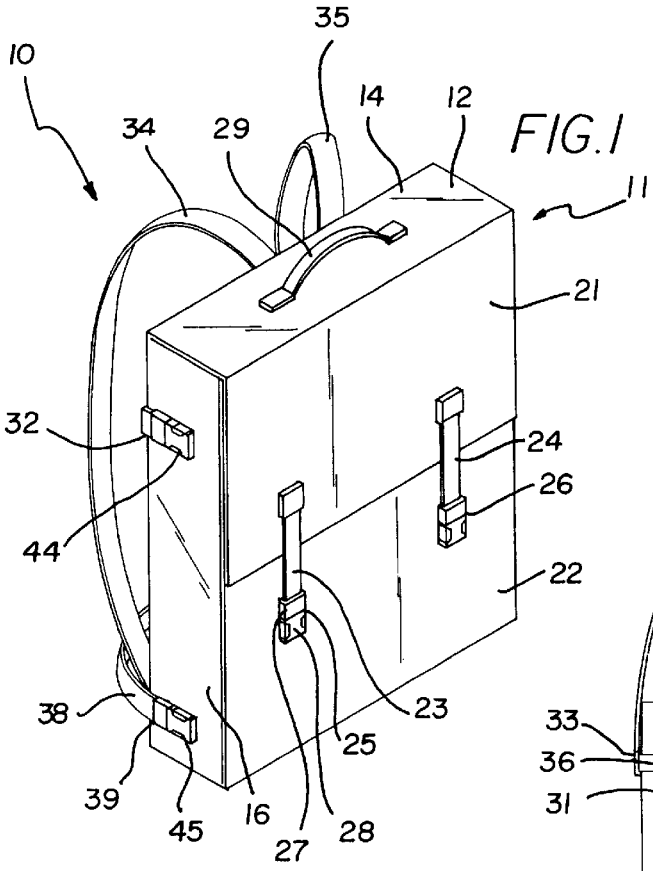
FIG. 1 is a schematic front perspective view of the outer case of the present invention.
Figure 2:
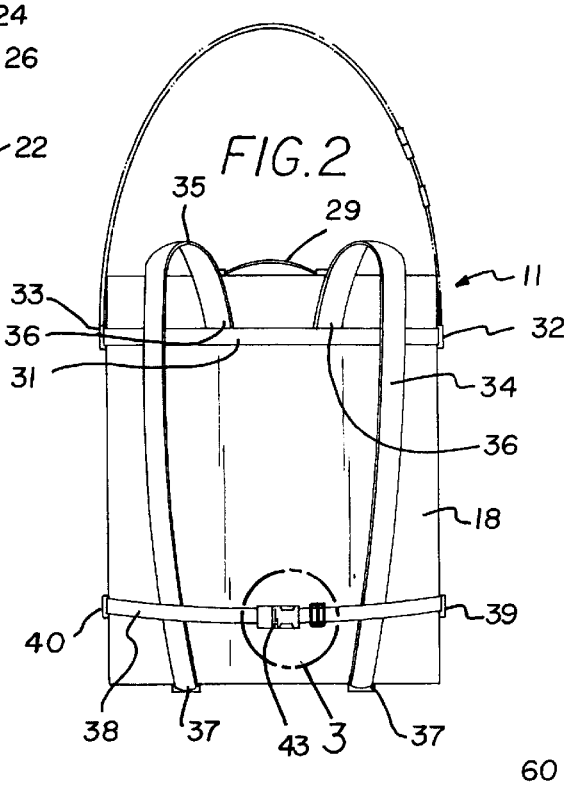
FIG. 2 is a schematic back side view of the outer case of the present invention.

With reference now to the drawings, and in particular to FIGS. 1 through 10 thereof, a new waterproof carrying bag and backpack embodying the principles and concepts of the present invention and generally designated by the reference numeral 10 will be described.

As best illustrated in FIGS. 1 through 10, the waterproof carrying bag and backpack 10 generally comprises an outer case 11 having top and bottom panels 14,15, a pair of side panels 16,17, a back panel 18 and an open front. The outer case 11 also has top and bottom flaps 21,22 substantially covering the open front of the outer case 11. A handle strap 29 is coupled to the top panel 14. A harness assembly 30 is detachably attached to the outer case 11 and comprises an elongate flexible top strap 31 and a pair of elongate flexible shoulder straps 34,35. A water proof inner pouch 47 is provided in the outer case 11 and is detachably attached to the back panel 18 of the outer case 11.

In closer detail, the outer case 11 is generally rectangular in configuration and has an exterior 12 and an interior 13, spaced apart generally rectangular top and bottom panels 14,15, a spaced apart pair of generally rectangular side panels 16,17 extending between the top and bottom panels 14,15, a generally rectangular back panel 18 interposed between the side panels 16,17 and extending between the top and bottom panels 14,15, and an open front. The outer case 11 preferably comprises a flexible nylon fabric material resistant to the passage of water therethrough between the exterior 12 and interior 13 of the outer case 11 such that water on the exterior 12 of the outer case 11 sheds off of the outer case 11. In an ideal illustrative embodiment, the outer case 11 has a height defined between the top and bottom panels 14,15 of about 45 cm, a width defined between the side panels 16,17 of about 45 cm, and a depth defined between the back panel 18 and the open front of between about 16 cm and about 20 cm.

The top panel 14 is pivotally coupled to the back panel 18 to permit pivoting of the top panel 14 to provide a top opening into the outer case 11. Each of the side panels 16,17 preferably has a generally rectangular side flap 19,20. The side flaps 19,20 of the side panels 16,17 extend inwardly towards one another. The side flaps 19,20 of the side panels 16,17 preferably lie in a common plane with the open front of the outer case 11.

The outer case 11 also has generally rectangular top and bottom flaps 21,22 substantially covering the open front of the outer case 11 such that the top and bottom flaps 21,22 substantially cover the side flaps 19,20 of the side panels 16,17. The top flap 21 of the outer case 11 is pivotally coupled to the top panel 14. The bottom flap 22 of the outer case 11 is pivotally coupled to the bottom panel 15. The top flap 21 of the outer case 11 overlaps the bottom flap 22 of the outer case 11 when the top and bottom flaps 21,22 substantially cover the open front of the outer case 11. The top flap 21 has a pair of spaced apart flexible fastening straps 23,24. Each of the fastening straps 23,24 has a free end detachably attached to the bottom flap 22 when the top and bottom flaps 21,22 substantially cover the open front of the outer case 11 to prevent access to the inside of the outer case 11 through the open front. Preferably, each of the fastening straps 23,24 has a clip fastener 25,26 detachably attaching the free end of the respective fastening strap 23,24 to the bottom flap 22. Each clip fastener 25,26 of the fastening straps 23,24 comprises complementary insertion and receiver portions 27,28. The insertion portions 27 of the clip fasteners 25,26 of the fastening straps 23,24 are coupled to the free end of the respective fastening strap 23,24. The receiver portions 28 of the clip fasteners 25,26 of the fastening straps 23,24 are coupled to the bottom flap 22 and spaced apart from one another.

The top panel 14 preferably has a flexible handle strap 29 coupled thereto to permit hand carrying of the outer case 11 by the top panel 14 such as in the manner of a briefcase.

The harness assembly 30 comprises an elongate flexible top strap 31 and a pair of elongate flexible shoulder straps 34,35. The top strap 31 of the harness assembly 30 has a pair of opposite ends 32,33. Each of the shoulder straps 34,35 of the harness assembly 30 has opposite upper and lower ends 36,37. The upper ends 36 of the shoulder straps 34,35 are coupled to the top strap 31 at a middle region between the ends 32,33 of the top strap 31. The top strap 31 is extended across the back panel 18 of the outer case 11 such that the ends 32,33 of the top strap 31 extend outwardly from either side of the back panel 18. A first of the ends of the top strap 31 is detachably attached to a first of the side panels 16 of the outer case 11 towards the top panel 14 of the outer case 11 and a second of the ends of the top strap 31 is detachably attached to a second of the side panels 17 of the outer case 11 towards the top panel 14 of the outer case 11. The lower ends 37 of the shoulder straps 34,35 are detachably attached to the bottom panel 15 of the outer case 11.

An elongate flexible waist strap 38 is preferably included having pair of opposite ends 39,40 and a pair of separable portions 41,42 detachably attached together at a point between the ends 39,40 of the waist strap 38. Preferably, a clip fastener 43 comprising complementary insertion and receiver portions 58,59 detachably attached the separable portions 41,42 together. Ideally, all of the clip fasteners in the invention comprise complementary insertion and receiver portions 58,59 of the type illustrated in FIG. 3 to allow quick attachment and detachment by a user of the clip fastener. Ideally, one of the separable portions 41,42 of the waist strap 38 also has an adjustably extendible length with a slide buckle 60 permitting lengthening and shortening of the length of the one separable portion of the waist strap 38. A first of the ends of the waist strap 38 is detachably attached to the first side panel 16 towards the bottom panel 15. A second of the ends 39,40 of the waist strap 38 is detachably attached to the second side panel 17 towards the bottom panel 15.

Figure 3:
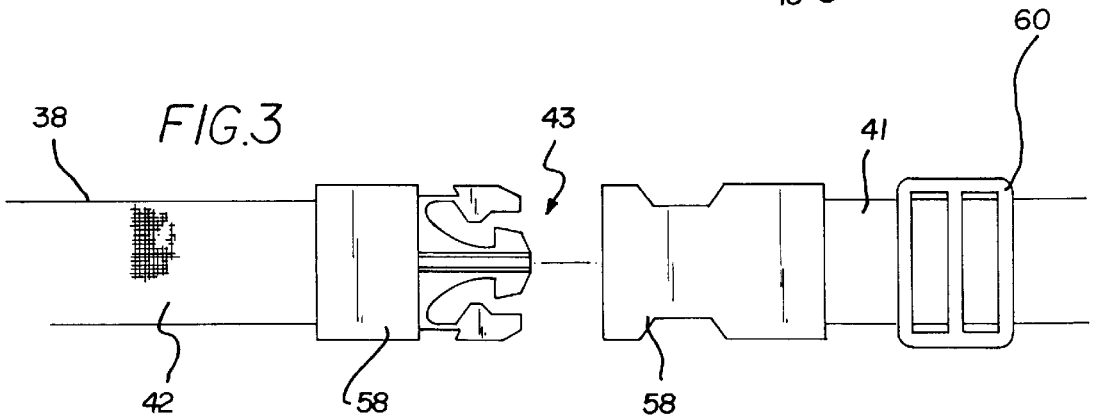
FIG. 3 is a schematic partial side view of the clip fastener of the waist strap of the present invention taken from the circle 3 of FIG. 2.
Figure 4:
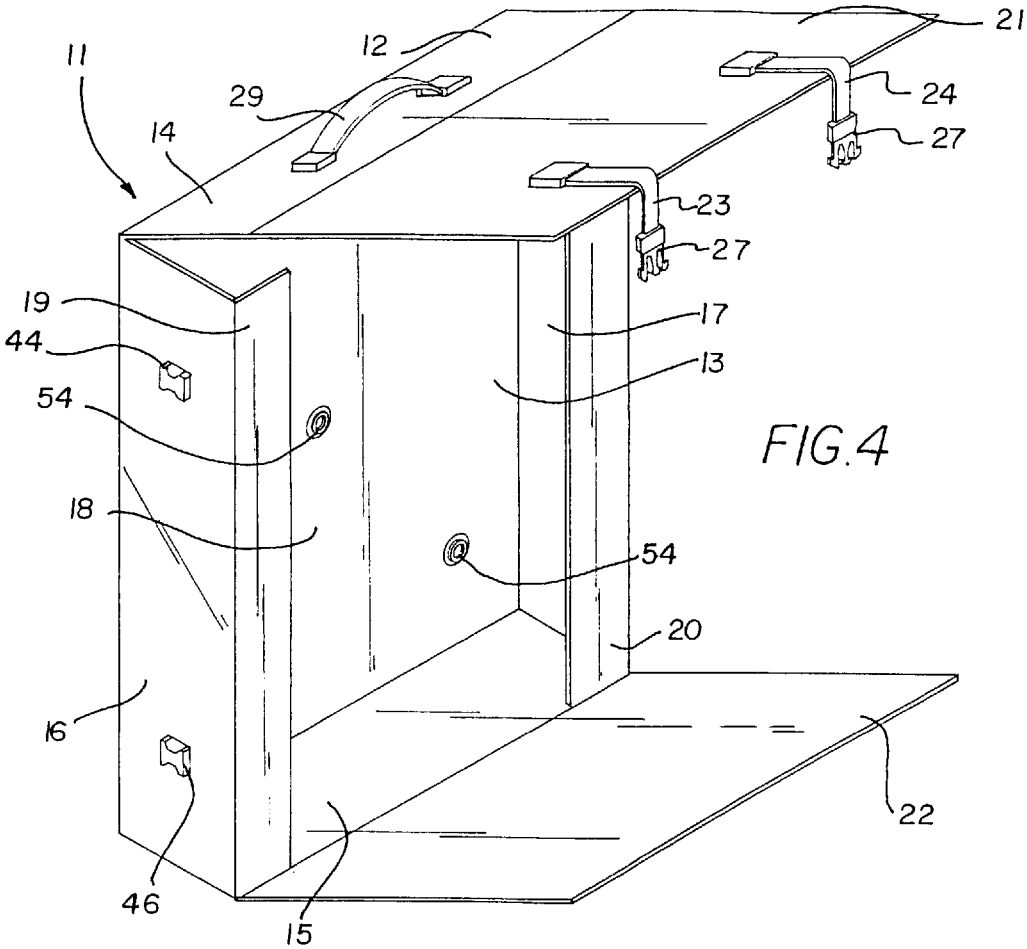
FIG. 4 is a schematic front perspective view of the outer case of the present invention with the top and bottom flaps open to reveal the interior of the outer case.

A plurality of interchangeable clip fasteners of the type illustrated in FIG. 3, detachably attach the ends 32,33,37 of the straps 31,34,35 of the harness assembly 30 and the waist strap 38 to the outer case 11. As noted, each clip fastener of the plurality of interchangeable clip fasteners comprising complementary insertion and receiver portions as illustrated in FIG. 3. The insertion portions of interchangeable clip fasteners are interchangeably insertable into the receiver portions of the interchangeable clip fasteners so that any insertion portion may be insertably attached to any receiver portion and vice versa.

The first and second ends 32,33 of the top strap 31 each has an insertion portion 58 coupled thereto. The lower ends 37 of the shoulder straps 34,35 each has an insertion portion 58 coupled thereto. The ends 39,40 of the waist strap 38 each have an insertion portion 58 coupled thereto. Each of the side panels 16,17 has a top receiver portion 44 pivotally coupled thereto towards the top panel 14 to permit pivoting of the top receiver portions 44 in planes generally parallel to the side panels 16,17. The insertion portions of the ends 32,33 of the top strap 31 are inserted into the top receiver portions 44 to detachably attach each end of the top strap 31 to the associated side panel.

Each of the side panels 16,17 also has a bottom receiver portion 46 coupled thereto towards the bottom panel 15. The insertion portions of the ends 39,40 of the waist strap 38 is inserted into the bottom receiver portion 46*s* to detachably attach each end 39,40 of the waist strap 38 to the associated side panel. Additionally as illustrated in FIG. 8, in use the insertion portions of the ends 39,40 of the waist strap 38 are also insertable into the top receiver portions 44 when the ends of the shoulder strap 34,35 are detached from the sides panels to form a single shoulder strap 34,35 over the top panel 14.

The bottom panel 15 has a pair of lower receiver portions 45 coupled thereto. The insertion portions of the lower ends 37 of the shoulder strap 34,35 are inserted into the lower receiver portions 45 to detachably attach each lower end 37 of the shoulder straps 34,35 to the bottom panel 15.

The inner pouch 47 is provided in the outer case 11 and has an open top, a bottom 48, a front 49, and a back 50. The inner pouch 47 also has front and back flaps 51,52 substantially covering the open top of the inner pouch 47. Preferably, a snap fastener 53 detachably attaches the back flap 52 to the front of the inner pouch 47 to prevent access into the inner pouch 47 through the open top of the inner pouch 47. The inner pouch 47 comprises a flexible water proof material substantially impermeable to passage of water therethrough. Ideally, the inner pouch 47 also comprises a transparent material to permit viewing of items in the inner pouch 47. The back of the inner pouch 47 is detachably attached to the interior 13 of the back panel 18 of the outer case 11 preferably, by a pair of snap fasteners 54.

Figure 5:
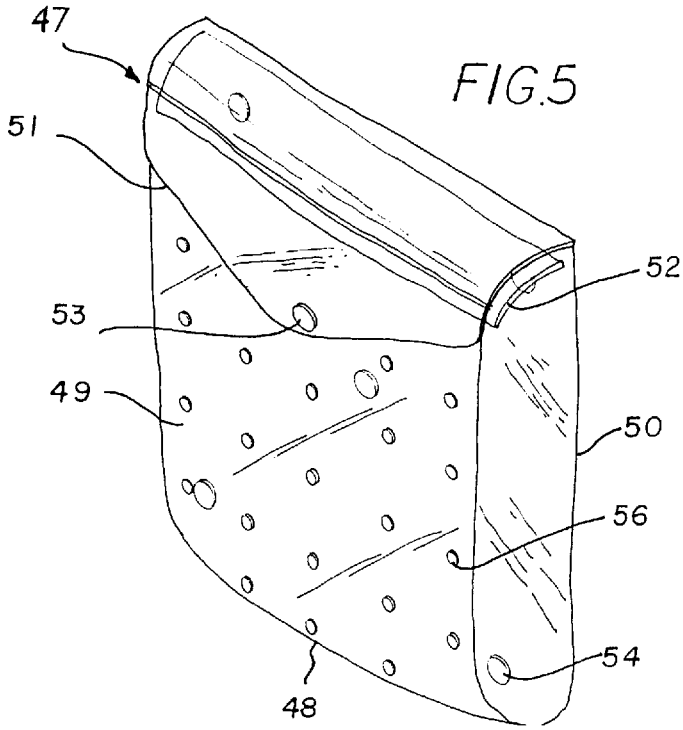
FIG. 5 is a schematic front perspective view of the inner pouch of the present invention.
Figure 6:
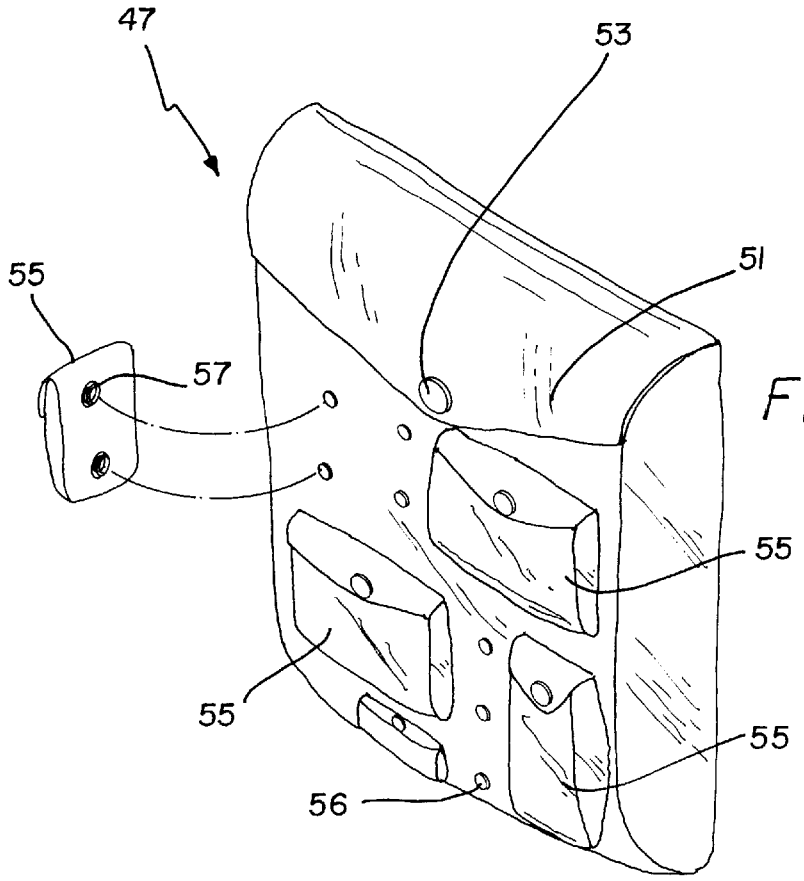
FIG. 6 is a schematic perspective view of the inner pouch of the present invention with compartment pouches attached to it.
Figure 7:
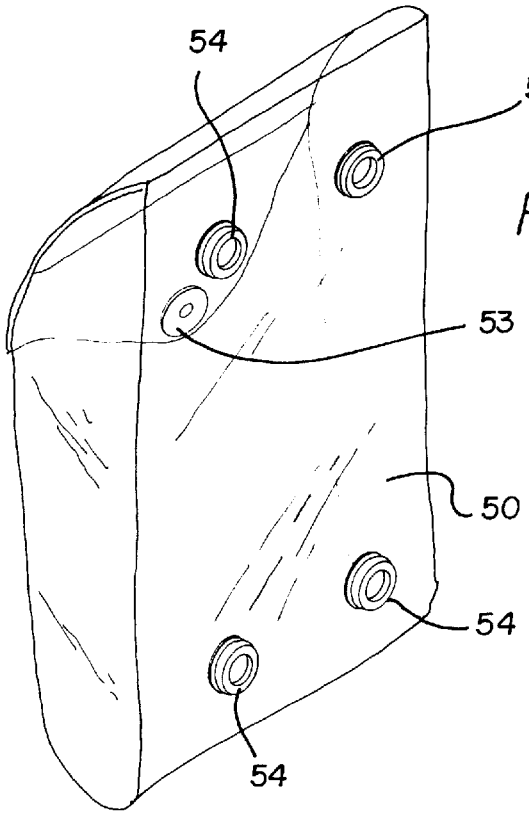
FIG. 7 is a schematic back perspective view of the inner pouch of the present invention.

Preferably, the front 49 of the inner pouch 47 has a plurality of compartment pouches 55 detachably attached thereto. The compartment pouches 55 are designed for holding small items therein such as glasses and cellular phones. Like the inner pouch, the compartment pouches 55 each preferably comprise a transparent flexible material to permit viewing of the items therein. A plurality of snap fasteners detachably attach the compartment pouches 55 to the front of the inner pouch 47. Preferably, each snap fastener comprises a first and second complementarily attachable snap portions 56,57. As illustrated in FIGS. 5 and 6, the front 49 of the inner pouch 47 has a plurality of the first snap portions 56 coupled thereto while each of the compartment pouches 55 has a plurality of the second snap portions 57 coupled thereto. The second snap portions 57 of the compartment pouches 55 are attachable to the first snap portions 56 of the front of the inner pouch 47 to permit the rearrangement of the compartment pouches 55 on the front of the pouch to suit the needs of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An waterproof carrying bag and backpack, comprising:

an outer case having exterior and interior surfaces, spaced apart top and bottom panels, a spaced apart pair of side panels extending between said top and bottom panels, a back panel interposed between said side panels and extending between said top and bottom panels, and an open front;

said top panel being pivotally coupled to said back panel to permit pivoting of said top panel to provide a top opening into said outer case;

said outer case having top and bottom flaps substantially covering said open front of said outer case;

said top flap of said outer case being pivotally coupled to said top panel, said bottom flap of said outer case being pivotally coupled to said bottom panel;

said top panel having a handle strap coupled thereto;

a harness assembly detachably attached to said outer case, said harness assembly comprising an elongate flexible top strap and a pair of elongate flexible shoulder straps;

an inner pouch being provided in said outer case and having an open top, a bottom, a front, and a back;

said inner pouch having front and back flaps substantially covering said open top of said inner pouch; and said back of said inner pouch being detachably attached to said interior of said back panel of said outer case; and wherein said top strap of said harness assembly has a pair of opposite ends, each of said shoulder straps of said harness assembly having opposite upper and lower ends, said upper ends of said shoulder straps being coupled to said top strap, said top strap being extended across said back panel of said outer case, a first of said ends of said top strap being detachably attached to a first of said side panels of said outer case towards said top panel of said outer case, a second of said ends of said top strap being detachably attached to a second of said side panels of said outer case towards said top panel of said outer case, and said lower ends of said shoulder straps being detachably attached to said bottom panel of said outer case.

2. The waterproof carrying bag and backpack of claim 1, wherein each of said side panels has a generally rectangular side flap, said side flaps of said side panels extending towards one another, said side flaps of said side panels, said side flaps of said side panels generally lying in a common plane with said open front of said outer case.

3. The waterproof carrying bag and backpack of claim 2, wherein said top and bottom flaps substantially cover said side flaps of said side panels.

4. The waterproof carrying bag and backpack of claim 1, wherein said top flap has a pair of fastening straps, each of said fastening straps having a free end detachably attached to said bottom flap when said top and bottom flaps substantially cover said open front of said outer case.

5. The waterproof carrying bag and backpack of claim 1, further comprising an elongate flexible waist strap having pair of opposite ends and a pair of separable portions detachably attached together at a point between said ends of said waist strap, a first of said ends of said waist strap being detachably attached to said first side panel towards said bottom panel, a second of said ends of said waist strap being detachably attached to said second side panel towards said bottom panel.

6. The waterproof carrying bag and backpack of claim 1, wherein a plurality of interchangeable clip fasteners detachably attach said ends of said straps of said harness assembly and said waist strap to said outer case, each clip fastener of said plurality of interchangeable clip fasteners comprising complementary insertion and receiver portions, said insertion portions of interchangeable clip fasteners being interchangeably insertable into said receiver portions of said interchangeable clip fasteners.

7. The waterproof carrying bag and backpack of claim 6, wherein said first and second ends of said top strap each have an insertion portion coupled thereto, said lower ends of said shoulder straps each have an insertion portion coupled thereto, said ends of said waist strap each have an insertion portion coupled thereto, each of said side panels having a top receiver portion pivotally coupled thereto towards said top panel, said insertion portions of said ends of said top strap being inserted into said top receiver portions to detachably attach each end of said top strap to the associated side panel, each of said side panels having a bottom receiver portion coupled thereto towards said bottom panel, said insertion portions of said ends of said waist strap being inserted into said bottom receiver portions to detachably attach each end of said waist strap to the associated side panel.

8. The waterproof carrying bag and backpack of claim 1, wherein said front of said inner pouch has a plurality of compartments detachably attached thereto.

9. An waterproof carrying bag and backpack, comprising:

an outer case being generally rectangular in configuration and having exterior and interior surfaces, spaced apart generally rectangular top and bottom panels, a spaced apart pair of generally rectangular side panels extending between said top and bottom panels, a generally rectangular back panel interposed between said side panels and extending between said top and bottom panels, and an open front;

said outer case comprising a flexible fabric material resistant to the passage of water therethrough between said exterior and interior surfaces of said outer case;

said top panel being pivotally coupled to said back panel to permit pivoting of said top panel to provide a top opening into said outer case;

each of said side panels having a generally rectangular side flap, said side flaps of said side panels extending towards one another, said side flaps of said side panels, said side flaps of said side panels generally lying in a common plane with said open front of said outer case;

said outer case having generally rectangular top and bottom flaps substantially covering said open front of said outer case such that said top and bottom flaps substantially cover said side flaps of said side panels;

said top flap of said outer case being pivotally coupled to said top panel, said bottom flap of said outer case being pivotally coupled to said bottom panel, said top flap of said outer case overlapping said bottom flap of said outer case when said top and bottom flaps substantially cover said open front of said outer case;

said top flap having a pair of fastening straps, each of said fastening straps having a free end detachably attached to said bottom flap when said top and bottom flaps substantially cover said open front of said outer case;

wherein each of said fastening straps has a clip fastener detachably attaching said free end of the respective fastening strap to said bottom flap;

each clip fastener of said fastening straps comprising complementary insertion and receiver portions, said insertion portions of said clip fasteners of said fastening straps being coupled to the free end of the respective fastening strap, said receiver portions of said clip fasteners of said fastening straps being coupled to said bottom flap and spaced apart from one another;

said top panel having a handle strap coupled thereto;

a harness assembly comprising an elongate flexible top strap and a pair of elongate flexible shoulder straps;

said top strap of said harness assembly having a pair of opposite ends;

each of said shoulder straps of said harness assembly having opposite upper and lower ends, said upper ends of said shoulder straps being coupled to said top strap;

said top strap being extended across said back panel of said outer case;

a first of said ends of said top strap being detachably attached to a first of said side panels of said outer case towards said top panel of said outer case, a second of said ends of said top strap being detachably attached to a second of said side panels of said outer case towards said top panel of said outer case;

said lower ends of said shoulder straps being detachably attached to said bottom panel of said outer case;

an elongate flexible waist strap having pair of opposite ends and a pair of separable portions detachably attached together at a point between said ends of said waist strap;

wherein a clip fastener comprising complementary insertion and receiver portions detachably attached said separable portions together;

wherein one of said separable portions of said waist strap has an adjustably extendible length;

a first of said ends of said waist strap being detachably attached to said first side panel towards said bottom panel, a second of said ends of said waist strap being detachably attached to said second side panel towards said bottom panel;

wherein a plurality of interchangeable clip fasteners detachably attach said ends of said straps of said harness assembly and said waist strap to said outer case, each clip fastener of said plurality of interchangeable clip fasteners comprising complementary insertion and receiver portions, said insertion portions of interchangeable clip fasteners being interchangeably insertable into said receiver portions of said interchangeable clip fasteners;

said first and second ends of said top strap each having an insertion portion coupled thereto;

said lower ends of said shoulder straps each having an insertion portion coupled thereto;

said ends of said waist strap each having an insertion portion coupled thereto;

each of said side panels having a top receiver portion pivotally coupled thereto towards said top panel;

said insertion portions of said ends of said top strap being inserted into said top receiver portions to detachably attach each end of said top strap to the associated side panel;

each of said side panels having a bottom receiver portion coupled thereto towards said bottom panel;

said insertion portions of said ends of said waist strap being inserted into said bottom receiver portions to detachably attach each end of said waist strap to the associated side panel;

an inner pouch being provided in said outer case and having an open top, a bottom, a front, and a back;

said inner pouch having front and back flaps substantially covering said open top of said inner pouch, wherein said snap fastener detachably attaches said back flap to said front of said inner pouch;

said inner pouch comprising a flexible water proof material substantially impermeable to passage of water therethrough, wherein said inner pouch comprises a transparent material to permit viewing of items in said inner pouch;

said back of said inner pouch being detachably attached to said interior of said back panel of said outer case, wherein a pair of snap fasteners detachably attach said back of said inner pouch to said interior of said back panel of said outer case; and said front of said inner pouch having a plurality of compartments detachably attached thereto, wherein snap fasteners detachably attach said compartments to said front of said inner pouch, each snap fastener comprising a first and second complementarily attachable snap portions, said front of said inner pouch having a plurality of said first snap portions coupled thereto, each of said compartments having a plurality of said second snap portions coupled thereto, said second snap portions of said compartments being attachable to said first snap portions of said front of said inner pouch.

* * * * *